US007748651B2

(12) United States Patent
Amari et al.

(10) Patent No.: US 7,748,651 B2
(45) Date of Patent: Jul. 6, 2010

(54) ELECTROSTATIC COATING SPRAY GUN

(75) Inventors: Masahiko Amari, Aichi (JP); Masami Murata, Aichi (JP); Takuho Sogawa, Aichi (JP)

(73) Assignee: Asahi Sunac Corporation, Aichi-ken (JP)

( * ) Notice: Subject to any disclaimer, the term of this patent is extended or adjusted under 35 U.S.C. 154(b) by 0 days.

(21) Appl. No.: 10/550,677

(22) PCT Filed: Mar. 19, 2004

(86) PCT No.: PCT/JP2004/003803

§ 371 (c)(1),
(2), (4) Date: Jul. 5, 2006

(87) PCT Pub. No.: WO2004/085078

PCT Pub. Date: Oct. 7, 2004

(65) Prior Publication Data

US 2007/0039546 A1 Feb. 22, 2007

(30) Foreign Application Priority Data

Mar. 27, 2003 (JP) ..... 2003-087882
Nov. 28, 2003 (JP) ..... 2003-399464

(51) Int. Cl.
*B05B 5/00* (2006.01)
*B05B 1/28* (2006.01)

(52) U.S. Cl. ..... 239/690; 239/706; 239/707; 239/290; 239/291

(58) Field of Classification Search ..... 239/690, 239/690.1, 704, 705, 706–708, 290, 291, 239/295, 296
See application file for complete search history.

(56) References Cited

U.S. PATENT DOCUMENTS 3,326,182 A 6/1967 Kiyoshi (Continued)

FOREIGN PATENT DOCUMENTS

GB 1 107 160 A 3/1968

(Continued)

OTHER PUBLICATIONS

Notification of Reasons for Refusal issued on Dec. 2, 2008 in corresponding Japanese Application No. 2005-504030 with English translation of same.

(Continued)

*Primary Examiner*—Davis Hwu
(74) *Attorney, Agent, or Firm*—Smith, Gambrell & Russell, LLP

(57) ABSTRACT

A spray gun suitable for electrostatic coating, using a coating material whose electric resistance is relatively low. A coating material nozzle is attached to the front middle region of a barrel having a forwardly projecting cylindrical section on the front outer peripheral edge, and an air cap which covers their front surfaces is installed. A pattern air flow channel is formed between the air cap, coating material nozzle outer peripheral surface and the cylindrical section inner peripheral surface, and an annular electrode is attached to the inside of the flow channel. The air cap is centrally provided with an atomization air spout hole, and a coating material delivery port at the front end of the coating material nozzle is inserted therein. A pin electrode is projected forward through the coating material delivery port. Two pairs of projections project forward from two sets of opposed locations for the air cap, each with a pattern air spout hole. The pin electrode is grounded and a high dc voltage is applied to the annular electrode.

7 Claims, 12 Drawing Sheets

U.S. PATENT DOCUMENTS

| | | | | | |
|---|---|---|---|---|---|
| 3,746,253 | A * | 7/1973 | Walberg | 239/705 |
| 3,907,202 | A * | 9/1975 | Binoche | 239/705 |
| 4,440,349 | A * | 4/1984 | Sickles et al. | 239/698 |
| 4,576,827 | A * | 3/1986 | Hastings et al. | 427/462 |
| 4,721,255 | A * | 1/1988 | Lind | 239/690 |
| 5,685,482 | A * | 11/1997 | Sickles | 239/3 |
| 6,425,533 | B1 * | 7/2002 | Shilton et al. | 239/290 |

FOREIGN PATENT DOCUMENTS

| | | | |
|---|---|---|---|
| JP | 43-29466 | B | 12/1968 |
| JP | S49111484 | U | 9/1974 |
| JP | 53-120750 | A | 10/1978 |
| JP | A-53-120750 | | 10/1978 |
| JP | 6-7709 | A | 1/1994 |
| JP | 06-134353 | | 5/1994 |
| JP | 7-213958 | A | 8/1995 |
| JP | 09-502647 | A | 3/1997 |
| JP | 09-136047 | | 5/1997 |
| JP | 11-99342 | A | 4/1999 |
| JP | 2002-143730 | | 5/2002 |
| JP | 2003-236415 | A | 8/2003 |

OTHER PUBLICATIONS

Supplemental European Search Report issued in corresponding European Application No. EP 04722085 dated Jul. 31, 2008.

* cited by examiner

ELECTROSTATIC COATING SPRAY GUN

TECHNICAL FIELD

The present invention relates to an electrostatic coating spray gun, in particular, to a spray gun suitable for electrostatic coating, using an aqueous coating material or a metallic coating material whose electric resistance is relatively low.

BACKGROUND ART

Generally, in coating materials used for electrostatic coating of vehicle bodies, etc., there is a solvent-based coating material (oil-based coating material) whose electric resistance is relatively high, an aqueous coating material (water-based coating material) whose electric resistance is relatively low, and a metallic coating material in which metallic powder is dispersed in the above coating materials. Of these, where carrying out electrostatic coating using an aqueous coating material or a metallic coating material whose electric resistance is relatively low, a current is caused to flow to the ground via a coating material feeding channel and a coating material tank if high voltage is applied directly to a charge electrode of an electrostatic coating spray gun which is brought into contact with the coating material. Therefore, no electric discharge is brought about between the charge electrode and a substance to be coated, wherein atomized coating material particles cannot be electrified.

As a prior art to solve the problem, for example, there is a method for electrically insulating a coating material tank from the ground. According to the method, high voltage can be applied between a charge electrode of an electrostatic coating spray gun and a substance to be coated, wherein coating material particles can be electrified. However, it is necessary that painting or coating work is interrupted when supplementing a coating material since high voltage is applied to the coating material tank, or a special coating material supplementing apparatus (for example, refer to JP-A-2002-143730) is required, which supplies a coating material in a state where electric insulation from the coating material tank is maintained. Therefore, it is inconvenient.

As another solving means, there is a system called an "external electrode system" in which one or a plurality of external electrodes is (are) disposed at an outward position in the diametrical direction from an electrostatic coating spray gun, and high voltage is applied thereto. In this system, there is a system (for example, refer to JP-A-H06-134353) in which a rotary atomizer head is used to atomize a coating material in an electrostatic coating spray gun, and an air spray system (for example, JP-A-H09-136047) in which compressed air is used. In both systems, since there is no case where an external electrode for applying high voltage is brought into contact with a coating material whose electric resistance is low, it is possible to electrify coating material particles with the coating material tank grounded. Accordingly, no special apparatus is required to supply a coating material into a coating material tank, wherein continuous coating is enabled.

However, since, in the case of the external electrode system, the external electrode is attached outside an electrostatic coating spray gun, the electrostatic coating spray gun is made large-sized, and this is dangerous because the electrode to which high voltage is applied is provided outside the main body. In addition, there is another problem in that atomized coating material particles are adhered to the vicinity of the external electrode or the surrounding of the electrostatic coating spray gun due to an electrostatic force.

DISCLOSURE OF THE INVENTION

The invention was made based from such backgrounds. It is therefore an object of the invention to provide an air spray type electrostatic coating spray gun that can be used for electrostatic coating using an aqueous coating material and metallic coating material whose electric resistance is relatively low, is able to carry out coating with its coating material tank grounded, and has a compact structure in which no electrode is provided outside the main body.

An embodiment of the invention features an electrostatic coating spray gun for electrifying a coating material atomized by compressed air using high voltage and coating the same onto a substance to be coated. The spray gun preferably has a barrel constituting a main body of the spray gun, an air cap mounted on a front of the barrel, a coating material delivery port which is defined in a central part of the air cap and is open outwardly. Further featured is a centralized electrode protruding forward through the coating material delivery port, a pair of projections formed at respective radial upper and lower positions of the air cap while sandwiching the centralized electrode therebetween, and the projections protruding farther forward than the coating material delivery port. There is further preferably provided a pattern air flow channel formed in the projections so that compressed air is spouted inwardly forward with respect to the projections as well as a pair of insulatively shielded electrodes accommodated in the respective projections and having respective surfaces covered with an electrically insulating material. There is also preferably featured an arrangement wherein the centralized electrode is grounded and a high DC voltage is applied between the centralized electrode and the insulatively shielded electrodes.

An embodiment of the invention features an electrostatic coating spray gun for electrifying a coating material atomized by compressed air using high voltage and coating the same onto a substance to be coated. The spray gun preferably has a barrel constituting a main body of the spray gun, an air cap mounted on a front of the barrel, a coating material delivery port which is defined in a central part of the air cap and is open outwardly. Further featured is a centralized electrode protruding forward through the coating material delivery port, and at least one projection projecting forward from the coating material delivery port and positioned within a circumferential region extending about said centralized electrode, and the at least one projection forming part of the air cap so that the projection is radially spaced from the centralized electrode and the at least one projection receives an insulatively shielded electrode which shielded electrode has a surface covered with an electrically insulating material, and the insulatively shielded electrode is accommodated in the interior of the projection, wherein high dc voltage is applied between the centralized electrode and the insulatively shielded electrode.

In one embodiment there is included two opposed sets of projections (e.g., top-bottom and left-right locations) extending from the air cap, and corresponding first and second pairs of electrodes accommodated in the interior of respective projections.

In addition, in the case of an electrostatic coating spray gun of such a structure in which the floating electrode 50 is additionally provided, electric discharge occurs along the surface of the air cap between the floating electrode 50 and the pin electrode 31, and such an effect can thereby be brought about, by which the amount of coating material particles adhered to the surface of the air cap is reduced.

According to the electrostatic coating spray gun of such a structure, since the surface of the electrode to which high dc voltage is applied is covered up with an electrically insulating material, no current is allowed to flow between the insulatively shielded electrodes 13*a*, 13*b* and the pin electrode. Therefore, high voltage can be applied in a state where the interval between the insulatively shielded electrodes and the pin electrode is made comparatively narrow, wherein an intensive electric field can be generated in the vicinity of the pin electrode, in particular, in the vicinity of the tip end thereof, coating material particles atomized by atomization air can be electrified with the inverse polarity of the polarity of the insulatively shielded electrodes. The electrified coating material particles are conveyed in close proximity to a substance to be coated by means of pattern air, and can be coated onto the substance to be coated, by means of an electrostatic force. With such an action, according to the electrostatic coating spray gun, it is possible to carry out electrostatic coating of not only a solvent-based coating material but also an aqueous coating material and metallic coating material whose electric resistance is relatively low. In addition, since such an external electrode as in the prior art is not required, the spray gun can be formed compact.

BEST MODE FOR CARRYING OUT THE INVENTION

To clarify the invention in detail, a description is given with reference to the accompanying drawings.

Embodiment 1

Figure 1:
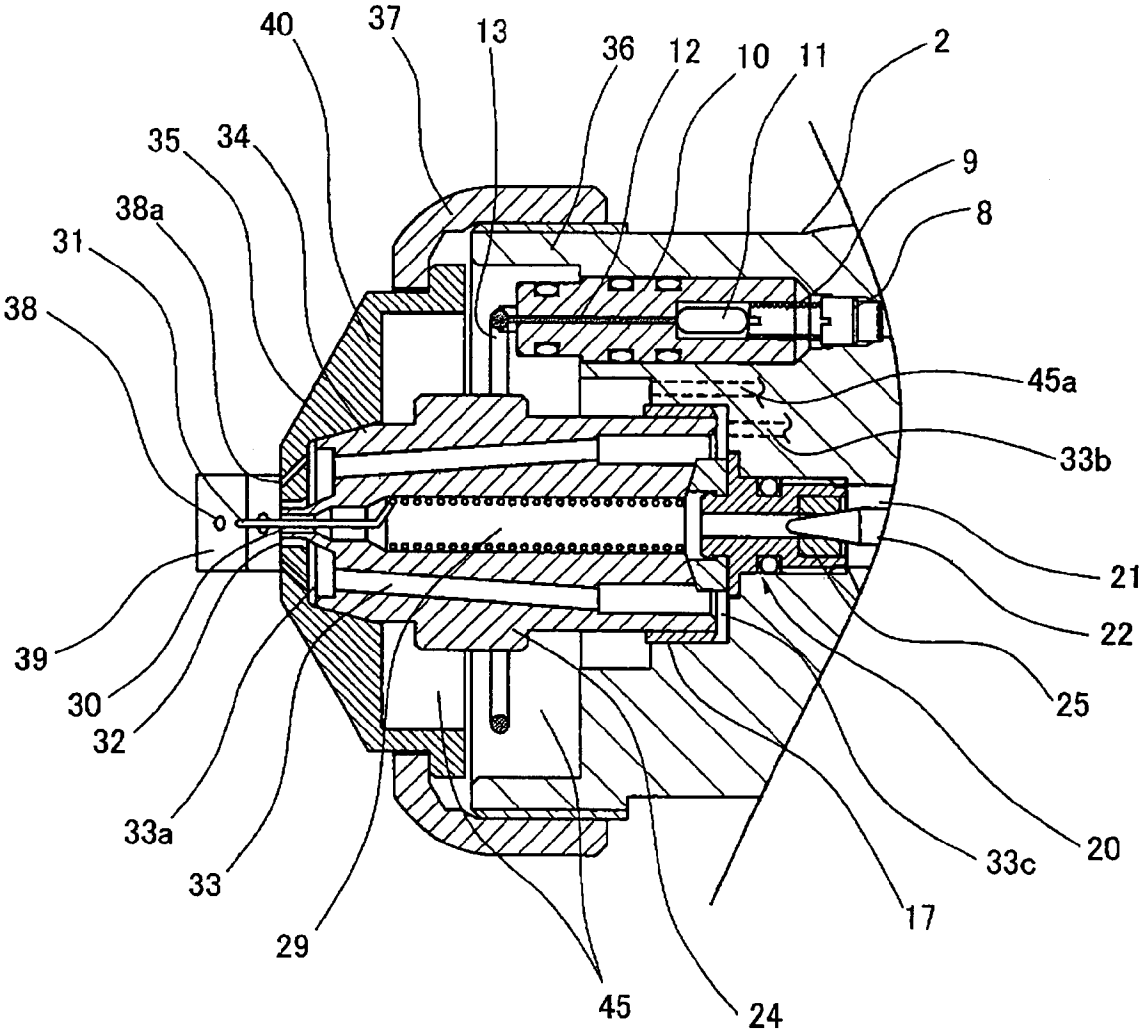
FIG. 1 is a longitudinal sectional view depicting the tip end region of a spray gun according to Embodiment 1.
Figure 2:
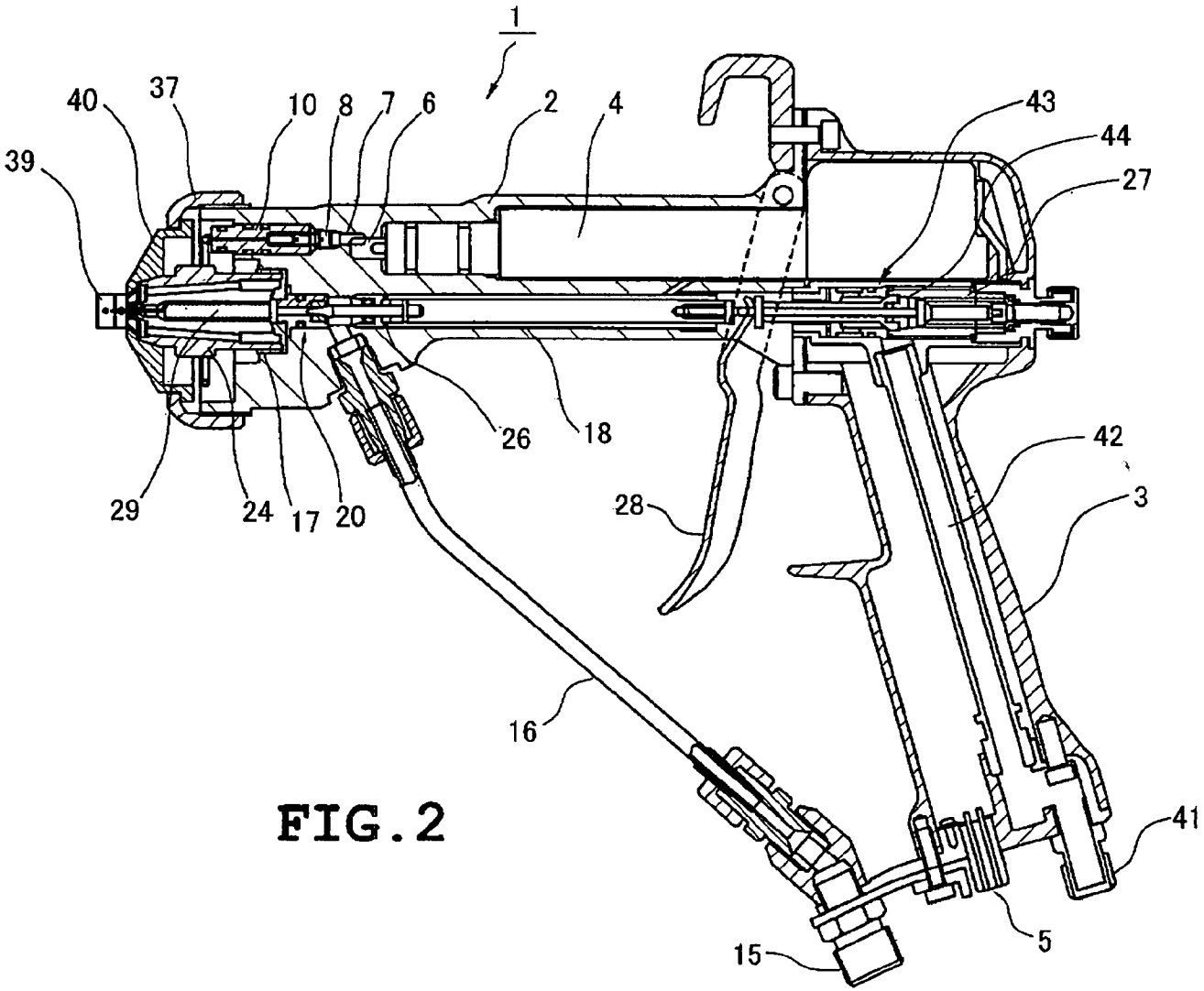
FIG. 2 is a longitudinal sectional view depicting a spray gun according to the invention.
Figure 3:
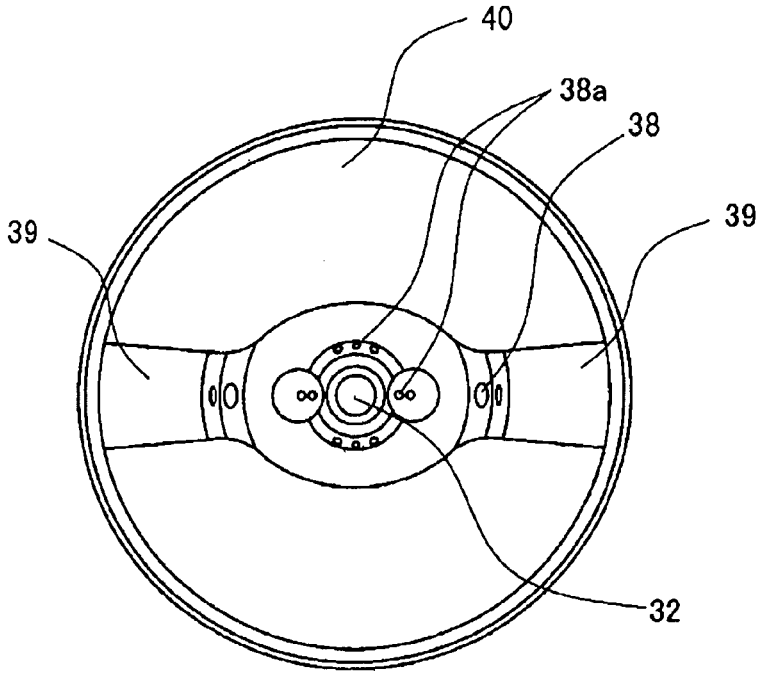
FIG. 3 is a front elevational view depicting a tip end air cap of the spray gun according to Embodiment 1.
Figure 4:
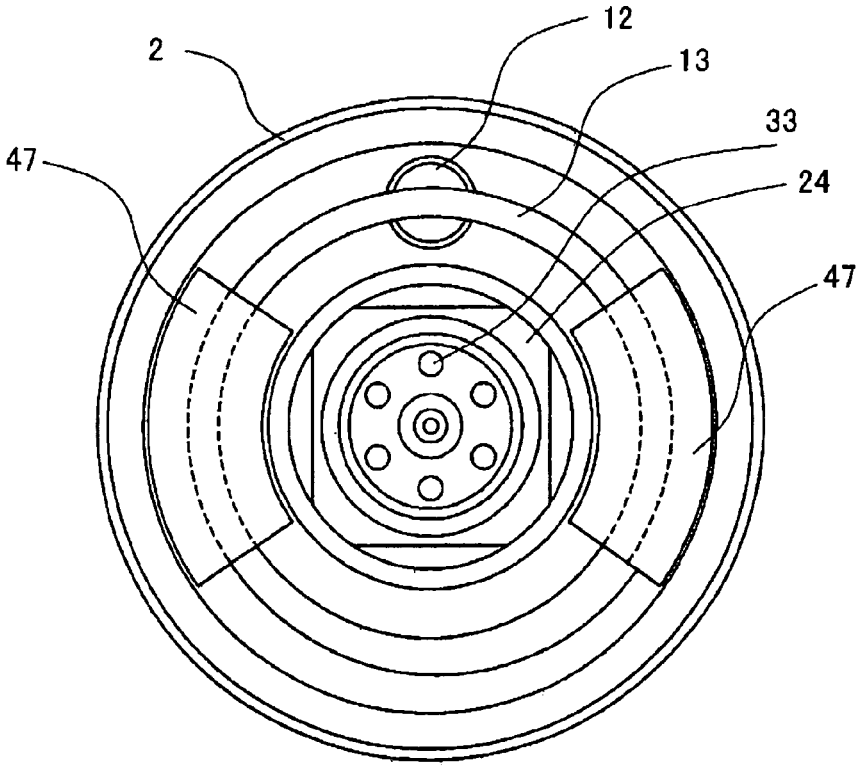
FIG. 4 is a front elevational view depicting the tip end region in a state where the tip end air cap of the spray gun according to Embodiment 1 is removed.

Hereinafter, a description is given of Embodiment 1 of an electrostatic coating spray gun (hereinafter called a "spray gun") according to the invention with reference to FIG. 1 through FIG. 5. A spray gun according to the embodiment mainly uses, as a coating material, aqueous coating material or metallic coating material whose electric resistance is relatively low. FIG. 2 depicts a longitudinal sectional view of the entire structure of a spray gun 1 according to the embodiment. FIG. 1 depicts a longitudinal sectional view of the tip end region. FIG. 3 depicts a front elevational view of a tip end air cap 40 described later. FIG. 4 depicts a front elevational view of the tip end region of the spray gun 1 with its air cap 40 removed, and FIG. 5 depicts an example of a circuit that generates high voltage.

The spray gun 1 is composed of a barrel (gun tube) 2, which is the main body of a gun, and a grip 3 attached to the rear end region thereof as depicted in FIG. 2. The barrel 2 is made of an insulative synthetic resin material and is formed to be columnar as the entirety. The spray gun 1 incorporates a high voltage generation circuit. A longitudinally long cascade 4 in which a step-up transformer necessary to generate high voltage and a high voltage rectification circuit are molded to be integrated together is accommodated in the upper part of the barrel 2.

Figure 5:
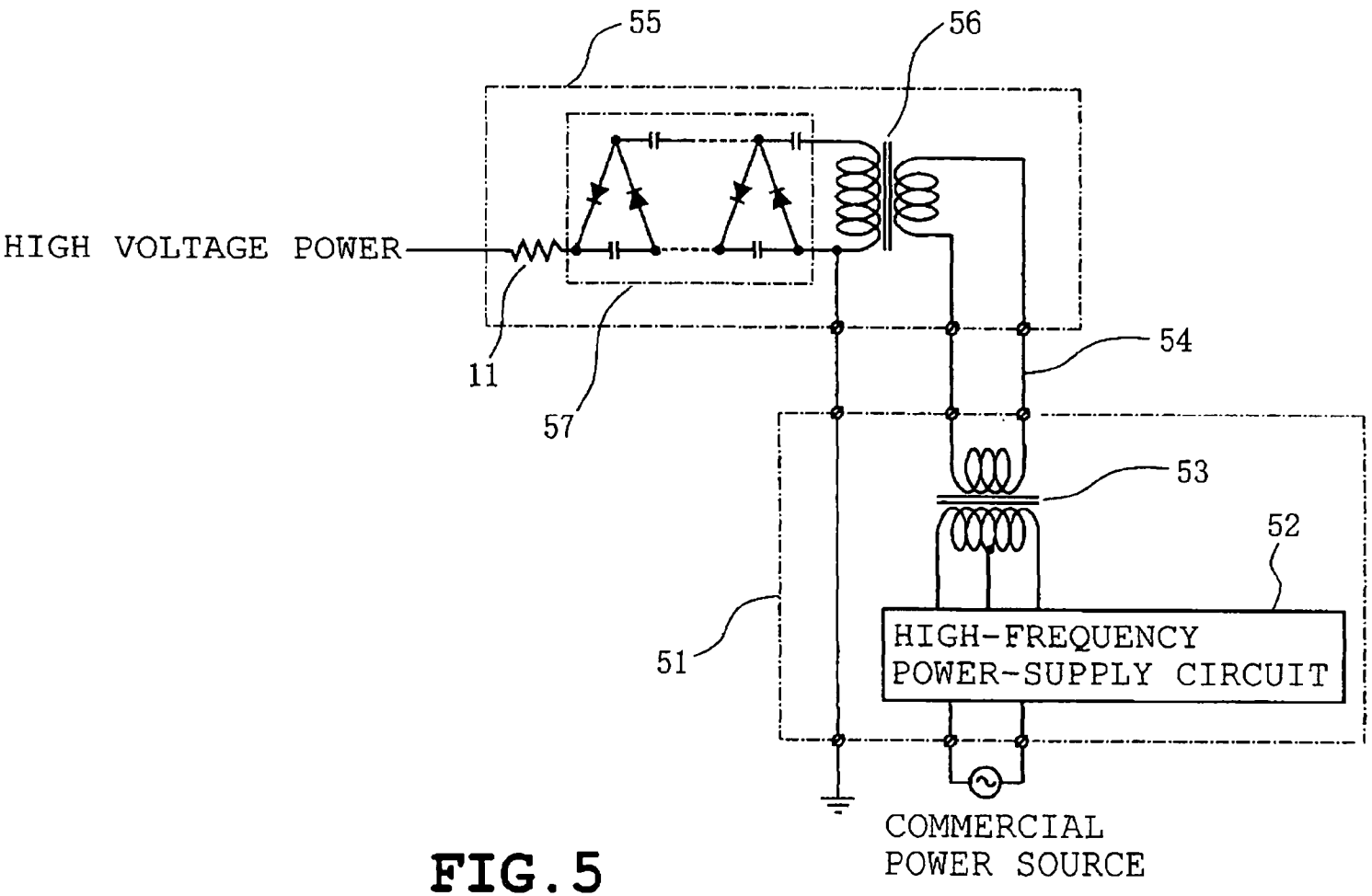
FIG. 5 is a configurational example of a high voltage generation circuit.

High voltage necessary for electrostatic coating is generated by a control circuit 51 and a high voltage generation circuit 55 as depicted in FIG. 5. The control circuit 51 is installed in the vicinity of a coating material tank (not illustrated), which is provided with a high frequency power source circuit 52 and an output transformer 53. As commercial power is supplied to the high frequency power source circuit 52, high frequency voltage is generated at the secondary side of the output transformer 53 connected to the output side thereof. The high frequency voltage thus generated is supplied to the primary side of a step-up transformer 56 in the high voltage generation circuit 55 secured in the cascade 4 in the spray gun 1 through a power source cable 54. The high frequency voltage stepped up by the step-up transformer 56 is multiplied and rectified by a Cockcroft-Walton voltage multiplying rectifier circuit 57 to generate high dc voltage which is 30,000 through 60,000 volts. Also, the polarity of the high voltage generated may be made positive (plus) or negative (minus) with respect to the grounding potential by varying the orientation of a diode in the Cockcroft-Walton voltage multiplying rectifier circuit 57.

The generated high dc voltage is led to the rear end side of a columnar conductive contactor 8 screwed in a hole drilled in the front part barrel 2 via a conductive spring 7 brought into contact with an output terminal 6 from the output terminal 6 at the front end of the cascade 4. And, the high dc voltage is picked up by another conductive spring 9 from the front end side of the contactor 8. A columnar resistance retainer 10 is screwed in a hole drilled from the front end surface of the barrel 2 and is attached to the front end side of the spring 9. The front end portion of the spring 9 is inserted into a hole drilled at the rear end side thereof, and a high resistor 11 inserted into the corresponding hole is pressed to the innermost end portion, and at the same time, high voltage is led to the rear end terminal of the high resistor 11. The front end terminal of the high resistor 11 penetrates the resistance retainer 10 from the innermost end portion of the hole and is brought into contact with the rear end surface of a conductor rod 12 slightly projecting from the front end surface of the resistance retainer 10. An electrode 13 described later is attached to and fixed at the tip end region of the projected conductor rod 12 by welding, etc. The high voltage thus generated passes through the high resistor 11 for limiting a current and is supplied to the electrode 13.

A coating material is supplied from a coating material tank (not illustrated) to a coating material hose joint 15 attached to the lower part of the grip 3 through a coating material hose (not illustrated). Then, the coating material is led into a valve chamber 21 of a coating material valve 20, passing through a coating material tube 16 therefrom. The coating material valve 20 is provided in a guide hole 18 drilled from the innermost middle region of a recess 17 secured at the front end middle region of the barrel 2 toward the rear end side in the barrel 2.

The coating material valve 20 is composed of a valve chamber 21, a needle 22, a guide hole 18, a valve port 25, and a packing 26. The needle 22 has its forward end part tapered and penetrates the valve chamber 21 in its longitudinal direction. The guide hole 18 guides the portion, which is rearward of the valve chamber 21 in the needle 22, movably in the longitudinal direction. The valve port 25 causes the coating material nozzle 24 described later, which is fixed at the front end of the coating material valve 20, and the valve chamber 21 to communicate with each other, and at the same time, is opened and closed by the tapered front end portion of the needle 22 being brought into contact with the valve port 25 and being separated therefrom. The packing 26 is mounted between the valve chamber 21 and the guide hole 18 and is adhered to the outer periphery of the needle 22 in a liquid-tight state.

The needle 22 in the coating material valve 20 is always kept in a closed state, where the valve port 25 is blocked, by pressing of a reset spring 27 secured at the rear end portion of the barrel 2, and prevents the supplied coating material from being discharged into the coating material nozzle 24. The needle 22 is caused to retreat against the reset spring 27 only while the trigger 28 is pulled, wherein the valve port 25 is opened, and the coating material valve 20 is entered into an open state. When the coating material valve 20 is opened, the coating material supplied into the valve chamber 21 is discharged into the coating material nozzle 24 attached forward of the coating material valve 20.

An attaching recess 17, whose section is circular, having such a mode as the middle region of the front end surface of the barrel 2 is notched, is formed at the front end portion of the barrel, and a coating material nozzle 24 made of an insulative synthetic resin material is fixed on the inner periphery of the attaching recess 17 so that the rear end portion thereof is screwed with the attaching recess 17 and the front end portion thereof is projected forward from the attaching recess 17.

The center hole penetrating the coating material nozzle 24 between both the front and rear end surfaces thereof is caused to communicate with the valve port 25 as a coating material flow channel 29. The front end of the coating material nozzle 24, that is, the region corresponding to the front end of the coating material flow channel 29 is formed to be projected with a small diameter, and is inserted into an atomization air spout hole 32 of the air cap 40 described later, as a coating material delivery port 30, in a state where the front end is open outwardly. The coating material supplied from the coating material valve 20 is discharged forward from the coating material delivery port 30 through the coating material flow channel 29.

A metallic pin electrode 31 whose diameter is smaller than the inner diameter of the coating material delivery port 30 is projected forward and is inserted into the coating material delivery port 30. The rear end side of the pin electrode 31 is formed to be coil spring-shaped, and is accommodated in the coating material flow channel 29, the pin electrode 31 is retained in a forwardly projected state by pressing of the spring. In the embodiment, an aqueous coating material and metallic coating material whose electric resistance is relatively low may be used as a coating material. The metallic pin electrode 31 is electrically connected to a grounded coating material tank (not illustrated) by conductivity of the coating material and is maintained at the grounding potential.

In the interior of the coating material nozzle 24, a plurality of atomization air flow channels 33 disposed concentrically with the coating material flow channel 29 are formed to be like holes penetrating both the front and rear end surfaces of the coating material nozzle 24. The front end of the atomization air flow channel 33 communicates with the annular atomization air flow channel 33*a* surrounded by the front end surface of the coating material nozzle 24 and the rear surface of the air cap 40.

The front end portion of the coating material nozzle 24 is covered up with the air cap 40. The front end outer peripheral region of the coating material nozzle 24 is annularly projected to be like a ring having a large diameter, and the annular projection portion 34 is fitted into the recessed region 35 at the rear surface of the air cap 40. In this state, the air cap 40 is fixed so as to be pressed to the coating material nozzle 24 by means of a retaining nut 37 screwed into the outer peripheral surface of the cylindrical section 36 formed to be projected forward from the front end outer peripheral edge of the barrel 2. As a result, an annular air gap surrounded by the rear surface of the air cap 40, the outer peripheral surface of the coating material nozzle 24, the inner peripheral surface of the cylindrical section 36 and the front end surface of the barrel 2 is formed. The air gap is utilized as a pattern air flow channel 45 and spacing for mounting the electrode 13.

The atomization air spout hole 32 is drilled at the middle region of the air cap 40, and the above-described coating material delivery port 30 is inserted there into. The atomization air spout hole 32 communicates with the above-described annular atomization air flow channel 33*a*, wherein atomization air is spouted forward through annular clearance between the inner periphery of the atomization air spout hole 32 and the outer periphery of the coating material delivery port 30. In addition, a plurality of sub-pattern air spout holes 38*a* communicating with the annular atomization air flow channel 33*a* are also drilled on the circumference of the atomization air spout hole 32, where compressed air supplied from the atomization air flow channel 33 is spouted as sub-pattern air.

Further, a pair of square sections 39 are formed at both ends of the surface of the air cap 40 so as to be opposed to each other in the left and right directions and to protrude forward thereof. A plurality of pattern air spout holes 38 (in FIG. 3, two holes at both left and right sides), which communicate with the above-described pattern air flow channel 45 are formed at the respective square sections 39, and pattern air of compressed air is diagonally spouted inwardly forward.

Compressed air for atomization air and pattern air is supplied to an air hose joint 41 attached to the lower part of the grip 3 from a compressed air generating apparatus (not illustrated) through a high-pressure air hose. The compressed air passes through the air flow channel 42 in the grip 3 and is led to an air valve 43 provided at the rear end region of the barrel 2.

The air valve 43 opens and shuts the compressed air supplied by a valve body 44 which moves forward and rearward along with the needle 22. When the coating material valve 20 is opened, the air valve 43 is also opened. When the coating material valve 20 is closed, and the air valve 43 is also closed. When the air valve 43 is opened, the compressed air is supplied to the annular atomization air flow channel 33*c* at the rear end of the coating material nozzle 24 and the annular pattern air flow channel 45 through the atomization air feeding channel 33*b* and the pattern air feeding channel 45*a*, which are provided in the barrel 2.

The electrode 13 to which high voltage is applied is formed annular. The electrode 13 is accommodated in the annular pattern air flow channel 45 between the outer peripheral surface of the coating material nozzle 24 and the inner peripheral surface of the cylindrical section 36 at the tip end of the barrel 2, and is attached to and fixed at the tip end of the conductor rod 12 slightly projecting from the front end surface of the resistor retainer 10 by welding, etc. An arcuate fixing member 47 made of an insulating material is attached to a part of the annular electrode 13 in order to prevent vibrations. The inner side of the fixing member 47 is in contact with the outer peripheral surface of the coating material nozzle 24, and the outer side thereof is in contact with the inner peripheral surface of the cylindrical section 36, and regulates movements of the electrode 13 and prevents its vibrations.

Next, a description is given of actions of the spray gun 1 according to the present embodiment, which is thus constructed. When the trigger 28 is pulled, the coating material valve 20 is opened, and coating material supplied through the joint 15 is discharged into the coating material flow channel 29. Further, the coating material is discharged to be like a film from the coating material delivery port 30 at the front end of the coating material nozzle 24 along the surface of the pin electrode 31. At the same time, high frequency voltage is supplied to the high voltage generation circuit 55 in the cascade 4, and high dc voltage of several tens of thousand of volts, which is generated by the high voltage multiplying rectifier circuit 57, is applied to the electrode 13 via the high resistor 11.

Since the pin electrode 31 is grounded by utilizing conductivity of a coating material, an intensive electric field directed from the surface of the pin electrode 31 to the electrode 13 to which high voltage is applied is generated. Therefore, a large amount of charges having the inverted polarity of the polarity of the high voltage of the electrode 13 is induced on the surface of the coating material having conductivity, which runs on the surface of the pin electrode 31. Also, as soon as the trigger 28 is pulled, compressed air passed through the atomization air flow channel 33 passes through the narrow clearance between the inner periphery of the atomization air spout hole 32 and the outer periphery of the coating material delivery port 30 and is spouted forward as atomization air. The atomization air is brought into collision with coating material running on the surface of the electrode 31 and atomizes the coating material by the spraying principle. Simultaneously with spouting of the atomization air, compressed air supplied from the atomization air flow channel 33 is spouted from the sub-pattern air spout holes 38*a* as the sub-pattern air. The sub-pattern air also takes on an additional role for atomization of the coating material.

The coating material particles thus atomized are burst out in the air with a charge induced when the coating material particles are brought into contact with the surface of the pin electrode 31. That is, the atomized coating material particles are electrified with an inverse polarity of the polarity of the electrode 13.

On the other hand, the compressed air supplied into the pattern air flow channel 45 are diagonally actively spouted inwardly forward from the pattern air spout hole 38 secured at the left and right square sections 39 as pattern air. The pattern air forms the spraying pattern of atomized coating material particles to be like an ellipse or oval shape suitable for coating. Also, the sub-pattern air spouted from the above-described sub-pattern air spout holes 38*a* takes on an additional role of formation of the spraying pattern.

The coating material particles are mainly conveyed to a close proximity of a substance to be coated, by means of the pattern air. As electrified coating material particles come near the substance to be coated, a charge of an inverse polarity of the charge of the coating material particles is induced by electrostatic induction on the surface of the grounded substance to be coated. Accordingly, an electrostatic force operates between the coating material and the induced charge having an inverse polarity, wherein the coating material particles are subjected to an absorption force directed to the substance to be coated. Based on both the absorption force and a blowing force based on the pattern air, the coating material particles are coated onto the surface of the substance to be coated. Since the absorption force is caused to operate by the electrostatic force, the coating material particles are taken into the rear side of the substance to be coated, wherein a coating material is coated onto the rear side portion of the substance to be coated, which does not face the spray gun 1. Based on the above-described action, the substance to be coated is electrostatically coated.

In addition, in the case of the present embodiment, electric lines of force are concentrated at the tip end of the pin electrode 31, and a high electric field is brought about. Therefore, there may be cases where electric discharge occurs at the tip end region of the pin electrode 31. A discharge current is caused to flow from the tip end of the pin electrode 31 to the electrode 13 through the pattern air spout hole 38. With the discharge, an ionized zone is formed in the vicinity of the tip end of the pin electrode 31, the atomized coating material particles receives a charge from the ionized zone, and there are cases where the amount of a charge and the polarity change. Since electrification (charge) based on electrostatic induction and electrification based on ions formed by discharge relate to each other, the electrifying mechanism of the atomized coating material particles is very complicated. In either case, since the pattern air spouted from the pattern air spout hole 38 is considerably intensive, the atomized coating material particles are conveyed to a close proximity of a substance to be coated, mainly by a conveyance force of the pattern air. And, the coating material particles are coated onto a substance to be coated, by both the absorption force based on an electrostatic force and a blowing force based on the pattern air.

With the spray gun 1 according to the present embodiment, it is possible to carry out electrostatic coating using an aqueous coating material or metallic coating material whose electric resistance is relatively low. In addition, since the electrode 13 is accommodated in the interior of the spray gun 1, the spray gun 1 can be made small-sized in comparison with the external electrode system. Further, since the electrode 13 to which high voltage is applied is accommodated in the barrel 2 of the spray gun 1, safety is further improved.

Embodiment 2

The present embodiment is such that some improvements are added to Embodiment 1. In the case of Embodiment 1, since an intensive electric field directed from the pin electrode 31 to the electrode 13 exists, polarization is generated in the synthetic resin material that forms the air cap 40, and a polarized charge of the same polarity as that of the electrode 13 is produced on the surface of the air cap 40. In this connection, a part of the changed coating material particles, deviated from a forward conveyance air stream of the pattern air, of the atomized charged particles is caught by the polarized charge and may be adhered to the surface of the air cap 40. In the present embodiment, improvements are added, which prevents a coating material from being adhered to the surface of the air cap 40.

Figure 6:
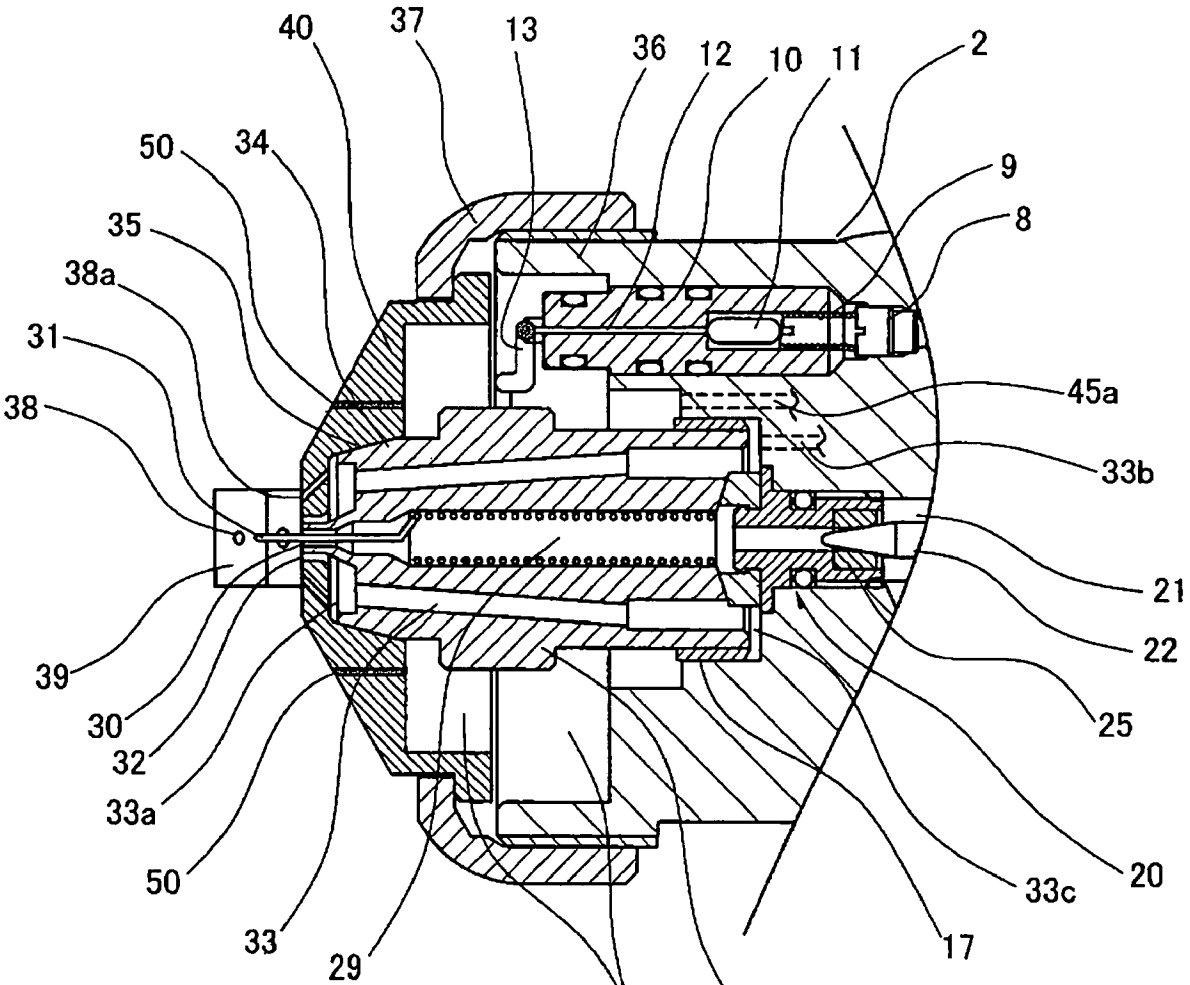
FIG. 6 is a longitudinal sectional view depicting the tip end region of a spray gun according to Embodiment 2.
Figure 7:
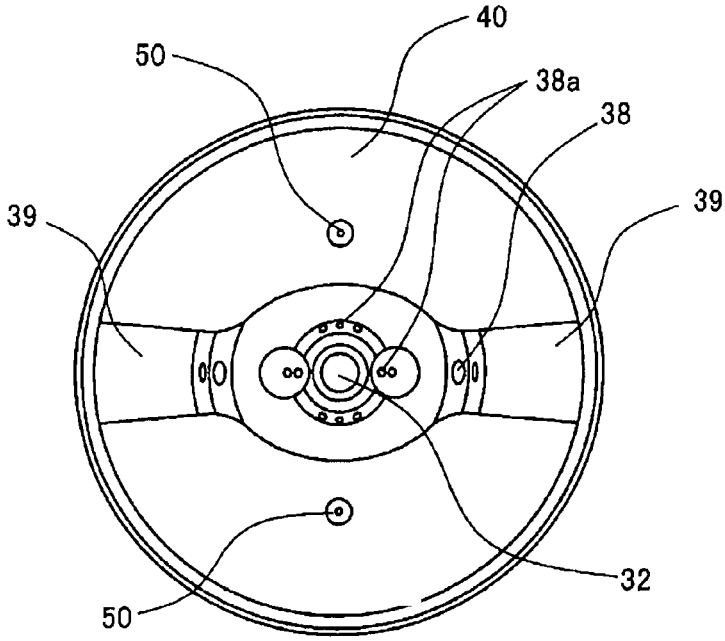
FIG. 7 is a front elevational view depicting the tip end air cap of the spray gun according to Embodiment 2.
Figure 8:
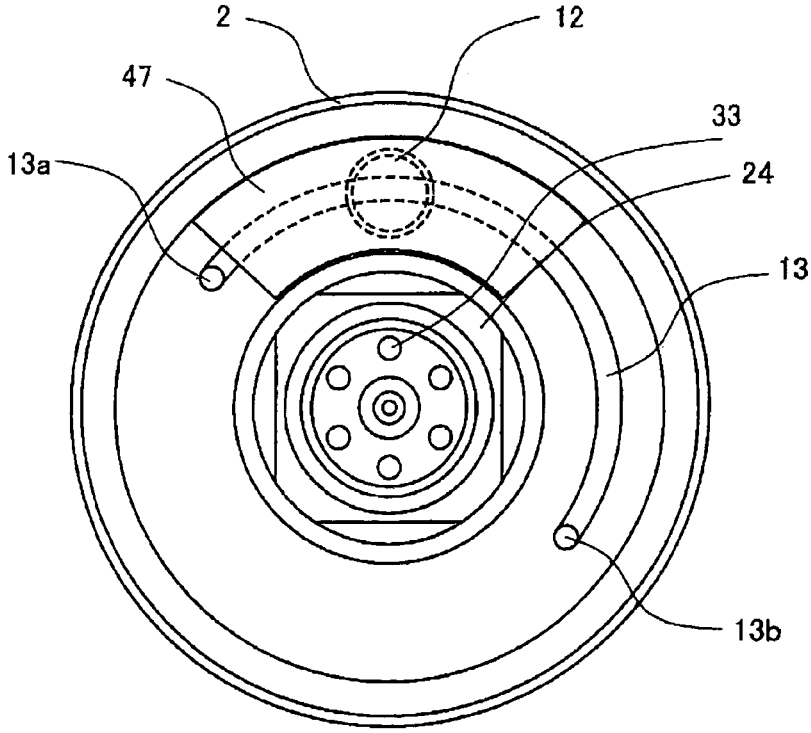
FIG. 8 is a front elevational view depicting the tip end region in a state where the tip end air cap of the spray gun according to Embodiment 2 is removed.

FIG. 6 is a longitudinal sectional view depicting the tip end region of the spray gun according to the present embodiment, FIG. 7 is a front elevational view depicting the tip end air cap 40, and FIG. 8 is a front elevational view depicting the tip end region in a state where the air cap is removed. Points at which the construction of the present embodiment differ from Embodiment 1 reside in that two floating electrodes 50 are added to the air cap 40, and the shape of the electrode 13 is altered. The other construction remains unchanged. Therefore, parts which are the same as or equivalent to those of Embodiment 1 are given the same reference numerals, and overlapping descriptions thereof are omitted.

The floating electrodes 50 are attached at positions symmetrical to each other with respect to the center axis of the air cap 40 on a line orthogonal to the line connecting a pair of square sections 39 passing through the center axis of the air cap 40. The distance from the center axis is roughly one-half the radius of the air cap 40, and the floating electrodes 50 are attached to the positions, penetrating the surface and rear surface of the air cap 40 in parallel to the center axis. The tip end position is made roughly coincident with the surface of the air cap 40, and the rear end is made roughly coincident with the rear surface of the air cap 40. The floating electrodes 50 are electrically floated from the ground and the electrode 13.

Figure 9:
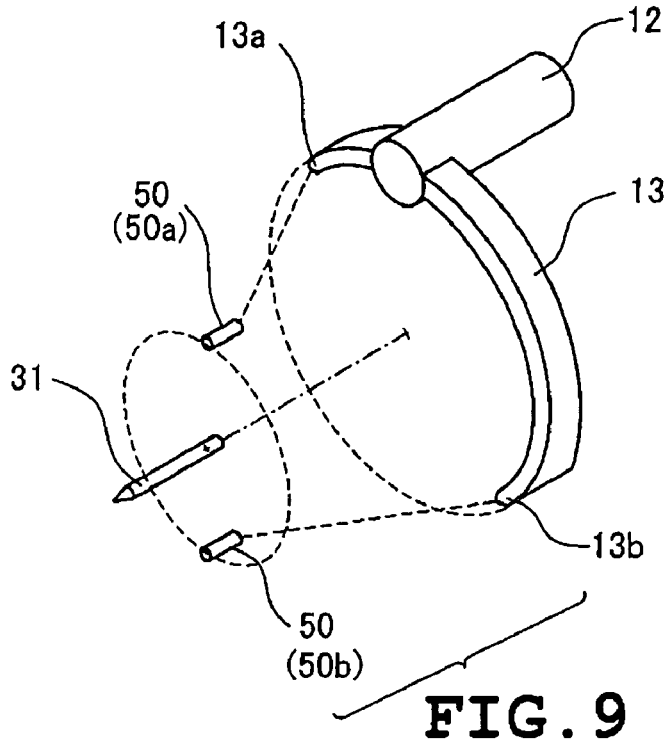
FIG. 9 is a perspective view depicting the positional relationship of respective electrodes of the spray gun according to Embodiment 2.

In the present embodiment, the electrode 13 is made semi-annular as depicted in FIG. 9, and is attached in the pattern air flow channel 45 so as to surround the coating material nozzle 24 as in Embodiment 1. FIG. 9 is a perspective view depicting a positional relationship among the electrode 13, the two floating electrodes 50 and the pin electrode 31.

The two floating electrodes 50 are located at positions symmetrical to each other with respect to the center axis of the air cap 40, and the center of the arc of the electrode 13 is made coincident with the center axis thereof. The electrode 13 is formed to be semi-annular, and both ends 13*a* and 13*b* thereof are located at positions symmetrical to each other with respect to the center axis. Therefore, the distance between one end 13*a* of the electrode 13 and one floating electrode 50*a* at the side closer thereto is made equal to the distance between the other end 13*b* of the electrode 13 and the other floating electrode 50*b*.

Figure 10:
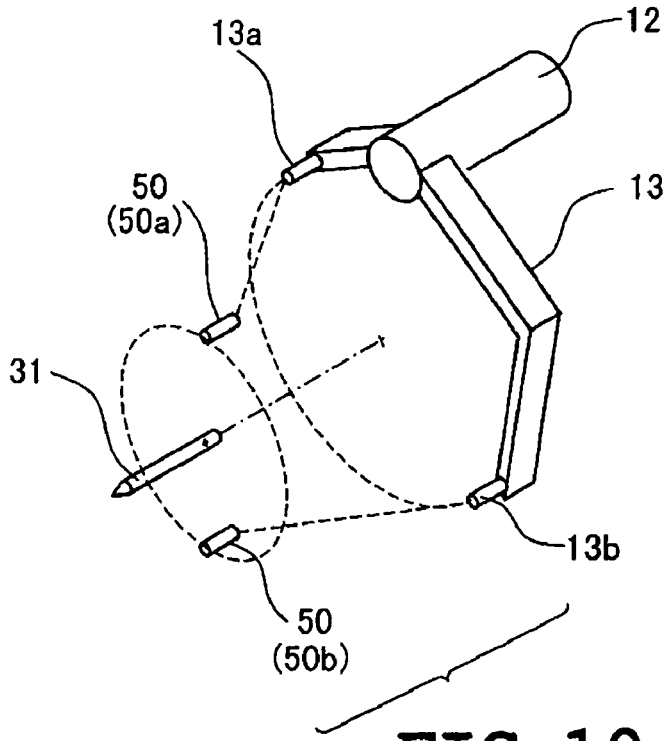
FIG. 10 is another perspective view depicting the positional relationship of respective electrodes of the spray gun according to Embodiment 2.

An important point of Embodiment 2 resides in that the two distances between both ends 13*a* and 13*b* of the electrode 13 and the two floating electrodes 50*a* and 50*b* are made equal to each other. If the two distances are equal, the shape of the electrode 13 does not much matter. Therefore, instead of making it semi-annular as depicted in FIG. 10, it may be formed into such a shape by which both the ends are located at positions symmetrical to each other with respect to the center axis, by bending a square band, a round bar, a wire, etc. Further, it is preferable that, as depicted in FIG. 10, small projections are formed toward the floating electrodes 50 or the tip end regions are bent toward the floating electrodes 50. In addition, in the case of Embodiment 2, an arcuate fixing member 47 made of an insulating material is attached to prevent the electrode 13 from vibrating.

Where electrostatic coating is carried out with high voltage applied in the construction according to the present embodiment, electric discharge may occur between the pin electrode 31 and the floating electrodes 50*a* and 50*b*, and between the electrodes 50*a*, 50*b* and both ends 13*a* and 13*b* of the electrode 13. In this case, since the distance between the floating electrode 50*a* and the electrode end 13*a* is made equal to the distance between the floating electrode 50*b* and the electrode end 13*b* as described above, the electric resistance in the discharge channel passing through the pin electrode 31, the floating electrode 50*a* and the electrode end 13*a* is made equal to the electric resistance in the discharge channel passing through the pin electrode 31, the floating electrode 50*b* and the electrode end 13*b*. Therefore, the discharge currents passing through the two discharge channels become almost equal to each other, wherein discharge phenomena of the same degree occur.

Discharge between the pin electrode 31 and the floating electrode 50*a* and discharge between the pin electrode 31 and the floating electrode 50*b* occur, mainly running on the surface of the air cap 40. If discharge thus occurs on the surface of the air cap 40, adhesion of coating material particles to the discharge channels and the surface region of the air cap 40 centering around the floating electrodes 50*a* and 50*b* is reduced.

The reason is considered as follows. First, since the surface of the air cap 40 and the rear surface thereof are short-circuited by the floating electrodes 50*a* and 50*b*, the synthetic resin material in the vicinity thereof is not subjected to polarization. Therefore, it is considered that, since no polarization charge occurs on the air cap 40, it becomes difficult for electrified coating material particles to be adhered. In fact, in the case of Embodiment 1 in which the floating electrodes 50*a* and 50*b* are not provided, although it is recognized that a charge remains on the surface of the air cap 40 immediately after coating stops, no residual charge is detected in the case of the present embodiment.

Secondarily, it is considered that an ionized area is formed, by a discharge along the surface, in the vicinity of the surface along the discharge channels and in the vicinity of the surface around the floating electrodes 50*a* and 50*b*. If an ionized area is produced, coating material particles bursting into the ionized area are electrified by the ions. Electrified coating material particles are repelled by each other because the polarities thereof are the same. Accordingly, it becomes difficult for the coating material particles to be adhered to the surface of the air cap 40.

In the case of the present embodiment, the electrification mechanism of atomized coating material particles is very complicated. It is considered that the coating material particles immediately after being atomized are subjected to an inverse polarity of the polarity of high voltage applied to the electrode 13 due to electrostatic induction. The electrified coating material particles are conveyed by pattern air to a close proximity of a substance to be coated. However, as for the coating material particles, on the way in conveyance, the quantity of the electrification charge and the polarity thereof may be delicately influenced by the ionized area produced by discharge on the surface of the above-described air cap 40 and ions which are produced by a discharge which may occur in the channel of the pin electrode 31, the pattern air spout hole 38, and the electrode 13 and a discharge between the floating electrode 50 and the electrode 13 inside the air cap 40, and are discharged from the pattern air spout hole 38 along with the pattern air.

In fact, it is observed that the polarity of electrified charge of the coating material particles conveyed to the proximity of a substance to be coated is inverted due to the spouting intensity of the pattern air. However, the arriving burst of the atomized coating material particles to a close proximity of a substance to be coated is carried out mainly by a conveyance force based on the pattern air, and the arrived burst of coating material particles induces a charge of an inverse polarity on the surface of the grounded substance to be coated, and the coating material particles are coated onto the substance to be coated, by means of both of an absorption force operating between the particles and the induced charge and a blowing force based on the pattern air.

With the spray gun 1 according to such an embodiment, an electric discharge occurs along the surface of the air cap 40 between the floating electrode 50 and the pin electrode 31, whereby such an effect can be brought about, by which the quantity of coating material particles adhered to the surface of the air cap 40 is reduced. In addition, as in Embodiment 1, since the electrode 13 to which high voltage is applied is accommodated in the interior of the barrel 2 of the spray gun 1, the spray gun 1 can be made small-sized. Such an effect can be brought about, by which safety is improved.

Embodiment 3

Figure 11:
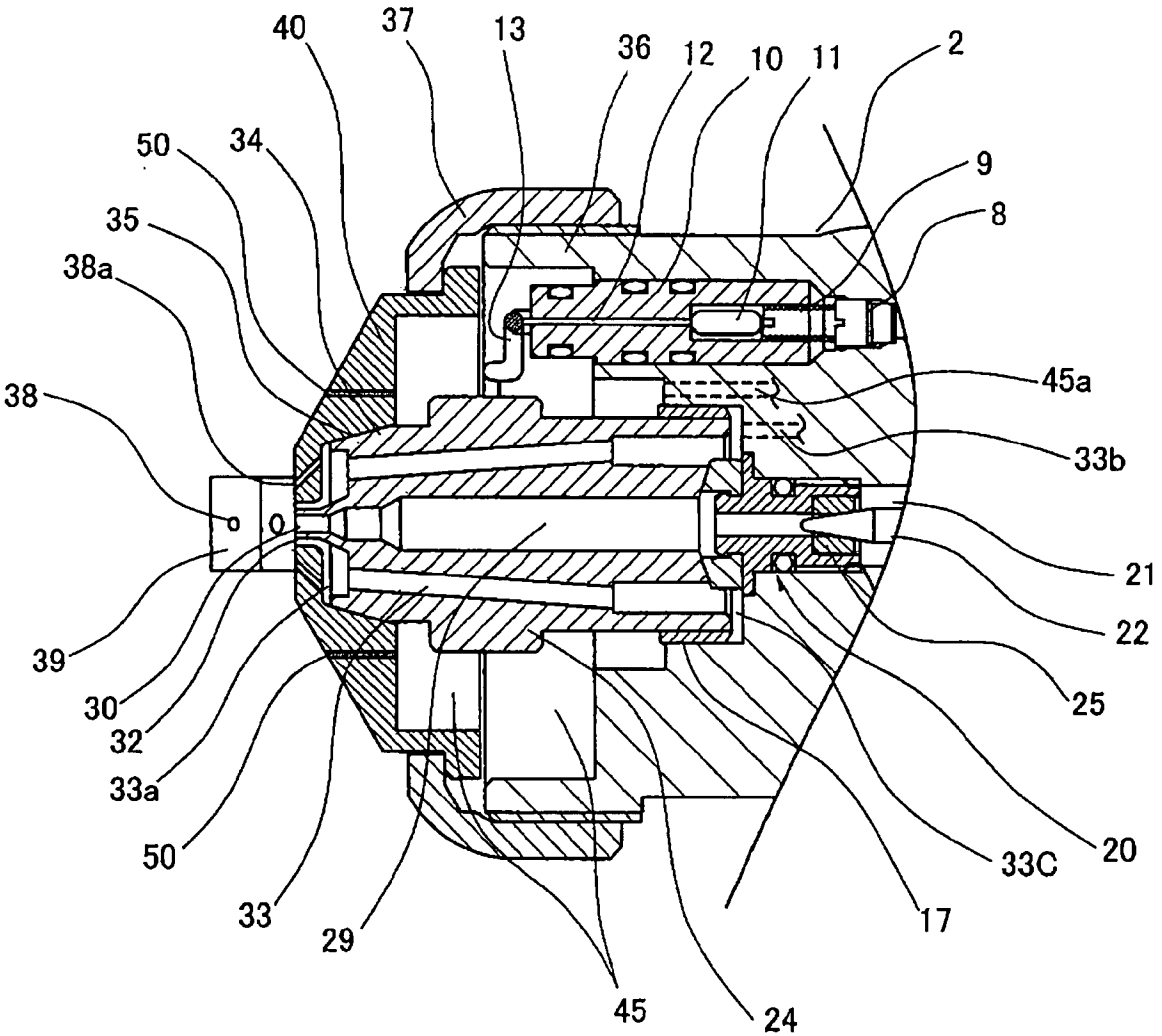
FIG. 11 is longitudinal sectional view depicting the tip end region of the spray gun according to Embodiment 3.

FIG. 11 is a longitudinal sectional view depicting the tip end region of the spray gun 1 according to the present embodiment. A point at which the present embodiment differs from Embodiment 2 resides only in that the pin electrode 31 is not provided. Generally speaking, an electric line of force is generated from a steepled part and a thin part, and the electric field intensity in the vicinity thereof is intensified. Based on this point, it is preferable that a thin pin electrode 31 is projected forward from inside the coating material delivery port 30. However, since the coating material itself has conductivity and is maintained at the grounding potential even if such a pin electrode 31 is not provided, the coating material can be atomized in an electrified state based on electrostatic induction. Also, an electric discharge occurs between the coating material at the outlet portion of the coating material delivery port 30 and the floating electrode 50 secured on the surface of the air cap 40. Therefore, as in Embodiment 2, electrostatic coating is enabled, and effects similar to those of Embodiment 2 can be brought about.

Embodiment 4

Figure 12:
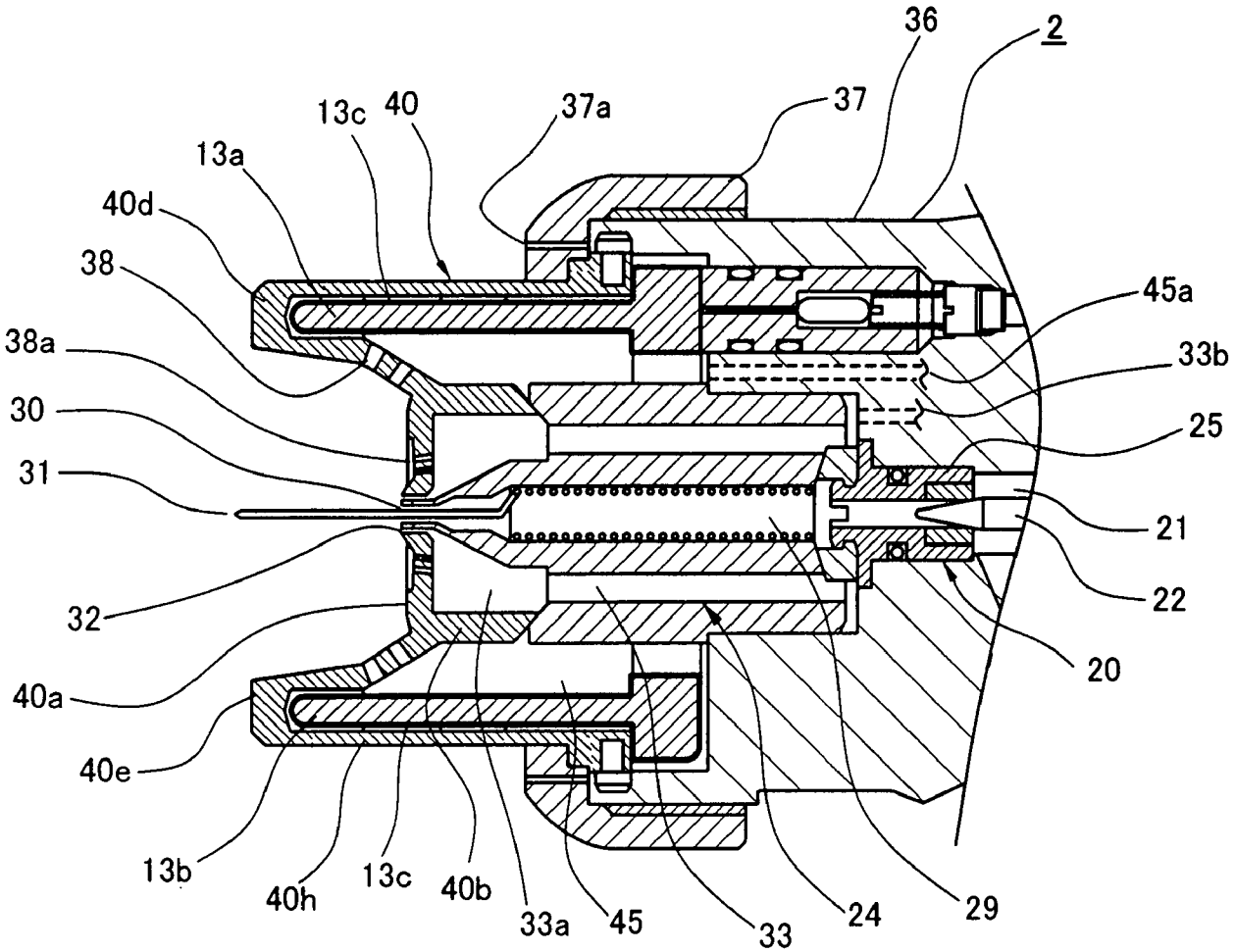
FIG. 12 is a longitudinal sectional view depicting the tip end region of the spray gun according to Embodiment 4.
Figure 13:
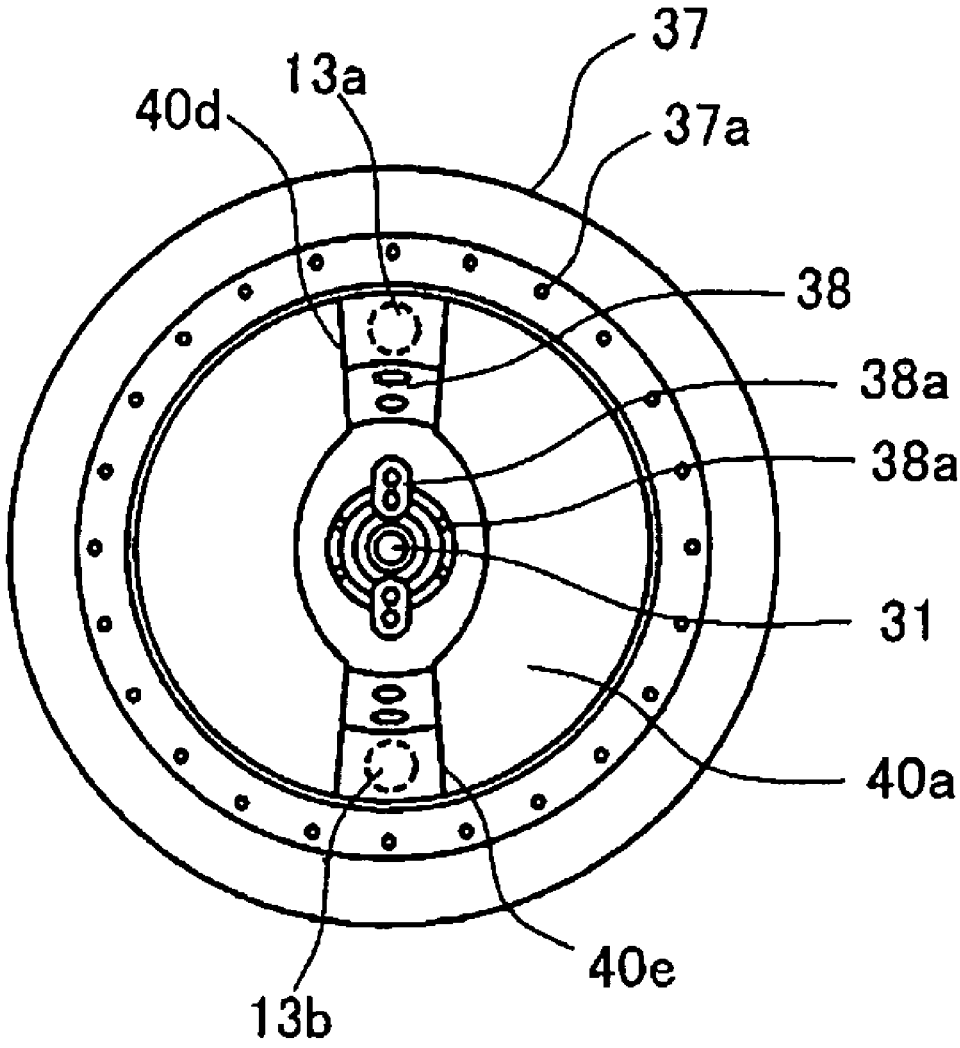
FIG. 13 is a front elevational view depicting the tip end air cap of the spray gun according to Embodiment 4.

FIG. 12 is a longitudinal sectional view depicting the tip end region of the spray gun 1 according to the present embodiment, and FIG. 13 is a front elevational view depicting the tip end region thereof.

A point at which the present embodiment differs from Embodiment 1 resides in the shapes of the electrode 13 and the air cap 40. The other construction thereof is the same as that of Embodiment 1. An air cap 40 according to the present embodiment covers up the tip end surface side of the coating material nozzle 24, is made of an insulative synthetic resin material and is formed to be double-cylindrical. The air cap 40 is attached so that the end face of the inner cylinder 40*b* is airtightly pressed to the outer peripheral tip end portion of the coating material nozzle 24, and is fixed by a retaining nut 37 screwed in the outer peripheral surface of the front end cylindrical section 36 of the barrel 2.

A portion surrounded by the inner cylinder 40*b*, the tapered tip end portion of the coating material nozzle 24 and the rear surface of the air cap 40 composes an annular atomization air flow channel 33*a*, and constructs a flow channel of atomization air, communicating with the atomization air flow channel 33 in the coating material nozzle 24. Further, space between the inner cylinder 40*b* and the outer cylinder 40*h* of the air cap 40 communicates with the pattern air flow channel 45 formed outside in the diametrical direction of the coating material nozzle 24 and forms a flow channel of the pattern air.

The atomization air spout hole 32 is drilled at the axis center of the front side wall portion 40*a* of the air cap 40, and the coating material delivery port 30 into which the pin electrode 31 is inserted is inserted into the hole 32 with the delivery port 30 opened outwardly. The atomization air spout hole 32 communicates with the above-described annular atomization air flow channel 33*a*, and atomization air is spouted forward through an annular clearance between the inner periphery of the atomization air spout hole 32 and the outer periphery of the coating material delivery port 30. In addition, a plurality of sub-pattern air spout holes 38*a* communicating with the annular atomization air flow channel 33*a* are drilled in the circumference of the atomization air spout hole 32 as well, and compressed air that is supplied from the atomization air flow channel is spouted forward as sub-pattern air.

Also, square sections 40*d* and 40*e* oppose each other and projecting forward are formed between the inner cylinder 40*b* and the outer cylinder 40*h* in the vertical direction including the center axis of the front side wall portion 40*a*. A plurality of pattern air spout holes 38 (in FIG. 12, two holes at the upper and lower sides), which communicate with the above-described pattern air flow channels 45, are formed at the respective square sections 40*d* and 40*e*, and pattern air being compressed air is diagonally spouted inwardly forward.

Figure 14:
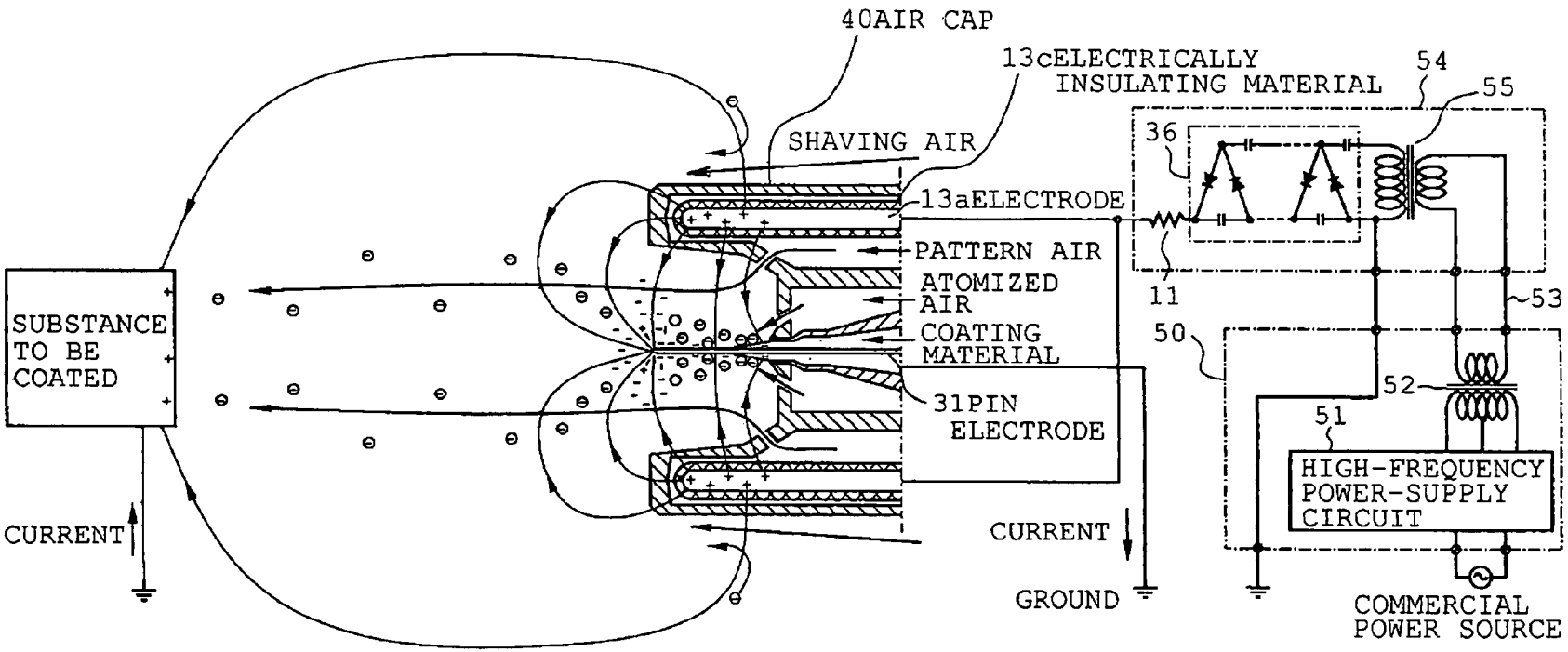
FIG. 14 is a schematic view describing the electric system and actions of the spray gun according to Embodiment 4.

Next, a description is given of operations and actions of the spray gun 1 according to the present embodiment thus constructed, with reference to a schematic diagram depicting connections of the electric system depicted in FIG. 14.

When coating, compressed air passed through the atomization air flow channel 33 is spouted from the atomization air spout hole 32 and the sub-pattern air spout holes 38*a*, and atomizes a coating material discharged from the coating material delivery port 30 of the coating material nozzle 24 by the spraying principle. Simultaneously therewith, pattern air passed through the pattern air flow channel 45 and spouted from the pattern air spout hole 38 is blown onto the atomized coating material particles, the spraying pattern of the coating material particles is formed to be like an ellipse or oval suitable for coating.

The greatest feature of the spray gun 1 according to the present embodiment resides in that insulatively shielded electrodes 13*a* and 13*b* whose surfaces are covered with an electrically insulating material 13*c* are accommodated in the interior of the above-described two square sections 40*d* and 40*e* which are provided at and projected from the upper and lower positions in the diametrical direction of the front side wall portion 40*a* of the air cap 40.

Positive high dc voltage generated in the high voltage generation circuit 55 is applied to the insulatively shielded electrodes 13*a* and 13*b* via the spring 9, high resistor 11 and conductor rod 12. The minus (negative) side of the high dc voltage is grounded via a return line (not illustrated) passing through the power source connector 5.

The pin electrode 31 is in contact with a coating material having conductivity as described above, and is grounded at the coating material tank side via the coating material. Accordingly, high dc voltage of several tens of thousand of volts, which is generated in the high voltage generation circuit 55, is added between the insulatively shielded electrodes 13*a*, 13*b* and the pin electrode 31.

Figure 15:
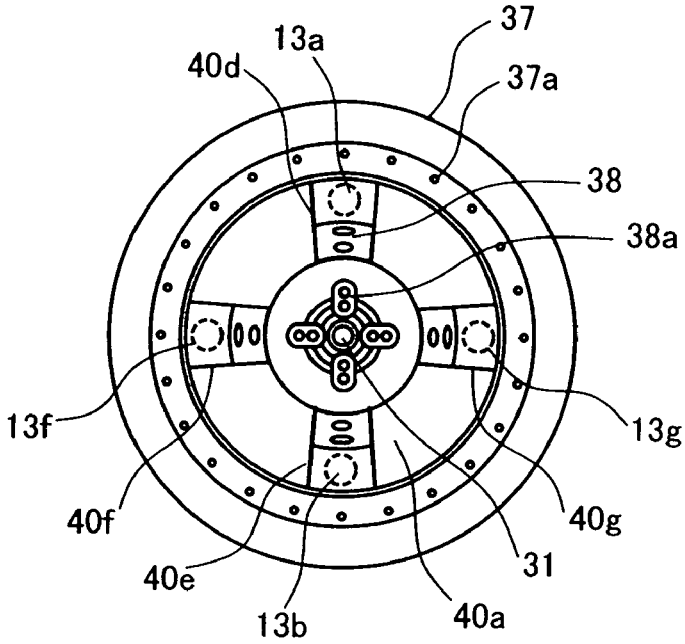
FIG. 15 is a front elevational view depicting a tip end air cap according to a modified embodiment of the spray gun according to the invention.

Next, a description is given of operations and actions of the spray gun 1 according to the present embodiment thus constructed, with reference to a schematic diagram depicting connections of the electric system depicted in FIG. 15.

As described in Embodiment 1 with reference to FIG. 5, high dc voltage of 30,000 volts through 60,000 volts is generated by the control circuit 51 and the high voltage generation circuit 55. The high dc voltage thus generated is applied between the insulatively shielded electrodes 13*a*, 13*b* and the pin electrode 31 via the high resistor 11 with the positive polarity set to the electrodes 13*a* and 13*b*. The electric lines of force emitted from the insulatively shielded electrodes 13*a* and 13*b* of positive polarity penetrate the air cap 40 formed of an insulating material, and the majority thereof reaches the grounded pin electrode 31. Since the pin electrode 31 is grounded via a coating material having conductivity, a large amount of negative (minus) charges is induced on the surface of the pin electrode 31 by electrostatic induction.

In this state, when the trigger 28 is pulled, the coating material valve 20 is opened, and a coating material in the valve chamber 21 is supplied to the coating material flow channel 29 of the coating material nozzle 24, and is discharged from the coating material delivery port 30 at the tip end of the coating material nozzle 24. The discharged coating material flows forward, running on the pin electrode 31. A negative charge is induced on the surface of the pin electrode 31. Since the coating material has conductivity, the coating material is given a negative charge from the pin electrode 31 while it flows forward, running on the pin electrode 31, and is electrified with negative polarity.

On the other hand, as soon as the trigger 28 is pulled, the air valve 43 is opened, and compressed air is supplied into the atomization air flow channel 33 and the pattern air flow channel 45 inside the air cap 40. The compressed air supplied into the atomization air flow channel 33 is spouted forward through the atomization air spout hole 32 and the sub-pattern air spout holes 38*a*, is brought into collision with the coating material running on the surface of the pin electrode 31 and atomizes the same. The atomized coating material bursts out as particles in a state where it has a negative charge electrified while it is in contact with the surface of the pin electrode 31. That is, the bursting out coating material particles are electrified with negative polarity.

On the other hand, compressed air supplied to the pattern air flow channel 45 is spouted forward of the front side wall portion 40*a* of the air cap 40 through the pattern air spout hole 38. And, coating material particles just atomized are caused to ride on streams of spouted air and are conveyed forward.

However, the electric lines of force emitted from the insulatively shielded electrodes 13*a* and 13*b* are concentrated, in large quantities, at the tip end region of the pin electrode 31 as depicted in FIG. 14. Therefore, the electric field intensity in the vicinity of the tip end of the pin electrode 31 is remarkably increased, air is ionized, wherein electrons having negative charge and ions having positive charge are generated. The generated electrons are accelerated by an intensive electric field along the electric lines of force, resulting in an electron avalanche, and air is ionized to generate a large amount of electrons and positive ions. On the other hand, although the generated positive ions are directed to the negative pin electrode 31, are brought into collision with the electrode, and are neutralized, a large amount of electrons are discharged from the surface of the pin electrode 31 when being brought into collision.

A large amount of electrons are generated in the vicinity of the tip end of the pin electrode 31 due to ionization of air and electron discharge from the pin electrode 31 based on such an electron avalanche, and are discharged to the periphery. As a result, a negatively ionized area in which a large amount of electrons exists is formed in the forward space area of the front side wall portion 40*a* of the air cap 40.

Coating material particles atomized in a negative-electrified state are conveyed forward by the pattern air and pass through the negatively ionized area. When passing through, the coating material particles are given electrons and are further electrified with the negative polarity.

The coating material particles passed through the negative-ionized area are further conveyed forward while forming an elliptical or oval spraying pattern by pattern air, and are conveyed to a close proximity of a substance to be coated. As the negative-electrified coating material particles approach the substance to be coated, positive charge is induced, by electrostatic induction, on the surface of the grounded substance to be coated. Thereby, the negative-electrified coating material particles are given an absorption force directed toward the substance to be coated, by an electrostatic force operating between the same and the induced positive charge.

With both the absorption force based on the electrostatic force and the blowing force based on the pattern air, the coating material particles are coated onto the surface of the substance to be coated. Since not only the blowing force based on the pattern air but also an absorption force based on the electrostatic force operate, the coating material particles are taken into the rear side of the substance to be coated, wherein a coating material is coated onto the rear side portion of the substance to be coated, which does not face the spray gun 1. Based on the above-described action, electrostatic coating is carried out on the substance to be coated.

In the case of the present embodiment, there is a worry that negative-electrified coating material particles are directed to the insulatively shielded electrodes 13*a* and 13*b* along the electric lines of force, and the particles are adhered to the surface of the front side wall portion 40*a* of the air cap 40 and the surface of the square sections 40*d* and 40*e* thereof. However, since compressed air is actively spouted forward from the front side wall portion 40*a* of the air cap 40 through the pattern air spout hole 38 and sub-pattern air spout holes 38*a*, adhesion of the coating material onto the front side wall portion 40*a* of the air cap 40 and the surface of the square sections 40*d* and 40*e* can be minimized.

However, of the electric lines of force emitting from the insulatively shielded electrodes 13*a* and 13*b*, there are some electric lines of force which outwardly penetrate the outer cylinder 40*h* of the air cap 40. If such electric lines of force exist, there is a fear that the coating material particles of negative charge, which are deviated from the spraying pattern, move along the electric lines of force and are adhered to the outward surface of the outer cylinder 40*h* of the air cap 40.

In order to prevent such adhesion, the spray gun 1 according to the present embodiment is constructed so that a part of the compressed air is spouted forward from a shaping air spout hole 37*a* secured at the retaining nut 37, which is concurrently used as a shaping air spout member. A number of shaping air spout holes 37*a* are disposed on the entire circumference of the retaining nut 37. Therefore, the coating material particles moved toward the surface of the outer cylinder 40*h* of the air cap 40 are blown off forward by the shaping air, wherein adhesion thereof onto the surface of the outer cylinder 40*h* can be prevented.

In the case of the present embodiment, the surface of the insulatively shielded electrodes 13*a* and 13*b* is covered up with an electrically insulating material 13*c*. Accordingly, no current is flown between the insulatively shielded electrodes 13*a*, 13*b* and the pin electrode 31. That is, the current does not continuously flow from the high voltage generation circuit 55 to the electrodes 13*a* and 13*b*, and high dc voltage generated in the high voltage generation circuit 55 is used only for charging the electrostatic capacitance between the electrodes 13*a*, 13*b* and the pin electrode 31 and generating a high electric field therebetween. Therefore, it is sufficient that the load current supply capacity of the high voltage generation circuit 55 is slight. This is a point which is remarkably different from the external electrode system listed in the paragraph of the background art.

No current flowing between the insulatively shielded electrodes 13*a*, 13*b* and the pin electrode 31 means that it is possible to make narrow the interval between the insulatively shielded electrodes 13*a*, 13*b* and the pin electrode 31. Accordingly, in the case of a spray gun 1 according to the present embodiment, there is an advantage in that a high electric field can be generated at the surrounding of the pin electrode 31 with a lower voltage than in the case of the external electrode system.

In addition, the atomization of the coating material is mainly by atomization air as described above. However, it is considered that an outward electrostatic force operating on the coating material electrified with negative charge, which is in contact with the pin electrode 31, by an intensive electric field existing between the insulatively shielded electrodes 13*a*, 13*b* and the pin electrode 31 also contributes to the atomization.

Since the negative-electrified coating material particles are adhered to a substance to be coated, by coming and flying from the pin electrode 31, a current is caused to flow from the substance toward the pin electrode 31, and the current flown into the pin electrode 31 is transmitted to the ground and is returned to the substance. That is, an electromotive force is produced along such a channel. That is, power generation is carried out. Energy necessary to produce the electromotive force is not supplied from the high voltage generation circuit 55 but from compressed air. Such a power generation principle is similar to the power generation principle of Wimshurst Influence Machine.

As described above, with the spray gun 1 according to the present embodiment, electrostatic coating using an aqueous coating material or a metallic coating material whose electric resistance is relatively low can be conducted in states where its coating material tank is grounded and adhesion of the coating material particles around the tip end of the spray gun 1 is reduced to the minimum. In addition, if the pin electrode 31 is grounded by a wiring cable, the spray gun 1 may be applicable to electrostatic coating using a solvent-based coating material whose electric resistance is high.

Modified Embodiment

Also, the present invention is not limited to only the embodiments described above. The invention may be applicable to the following modifications and expansions.

In the case of Embodiment 4, although the insulatively shielded electrodes 13*a* and 13*b* are accommodated in the interior of the square sections 40*d* and 40*e* of the air cap 40, the insulatively shielded electrodes 13*a* and 13*b* may be attached so as to project forward from the square sections 40*d* and 40*e* in a state where the surface of the electrodes 13*a* and 13*b* is electrically isolated. Even in this case, it is a matter of course that electrostatic coating may be executed as in the above-described embodiments.

Also, in the case of Embodiment 4, the insulatively shielded electrodes 13*a* and 13*b* are attached at the upper and lower positions in the diametrical direction with the pin electrode 31 placed therebetween. However, they may be attached at the left and right positions in the diametrical direction. Thereby, although the spraying pattern of the coating material particles becomes slightly different from the case of the above-described embodiment, similar electrostatic coating may be carried out.

In addition, in the case of Embodiment 4, the insulatively shielded electrodes 13*a* and 13*b* are provided by two in total. However, square sections 40*f* and 40*g* projecting forward may be provided at the left and right positions in the diametrical direction with the pin electrode 31 placed therebetween, and insulatively shielded electrodes 13*f* and 13*g* whose surface is covered up with an electrically insulating material may be accommodated in the corresponding square sections 40*f* and 40*g* (Refer to FIG. 15).

Figure 16:
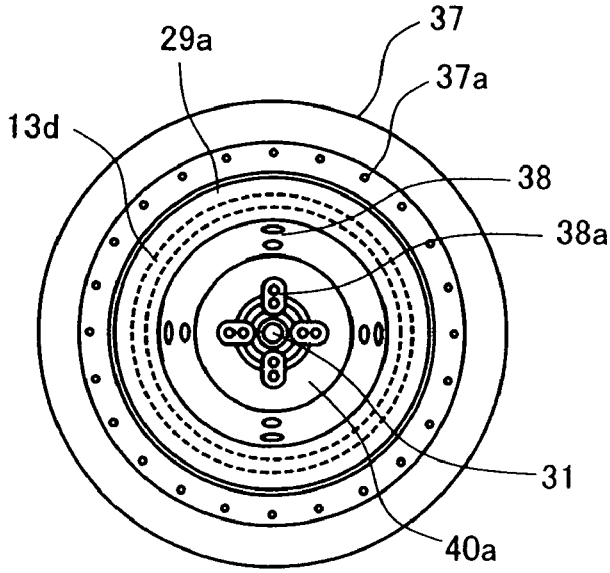
FIG. 16 is a front elevational view depicting a tip end air cap according to another modified embodiment of the spray gun according to the invention.

Also, in the case of Embodiment 4, a projecting ring-shaped portion 29*a* that surrounds the pin electrode 31 is formed instead of the above-described square sections 40*d* and 40*e*, wherein a ring-shaped insulatively shielded electrode 13*d* may be attached in the ring-shaped portion 29*a* (Refer to FIG. 16). Thereby, the electric field intensity in the vicinity of the pin electrode 31 is intensified, and such an effect is brought about, by which the negative ionized area can be widened.

Further, in the case of Embodiment 4, positive high voltage is applied to the insulatively shielded electrodes 13*a* and 13*b* and the pin electrode 31 is grounded to the minus (negative) side. However, the polarity may be inverted. In the inverted case, the coating material is atomized with positive charge, and a positively ionized area is formed at the surrounding of the pin electrode 31. Then, the coating material particles may be coated onto a substance to be coated, in a positive-electrified state, and electrostatic coating may be carried out as in the above-described embodiment.

Also, in the case of Embodiment 4, the pin electrode 31 is projected forward of the air cap 40 from the coating material delivery port 30 of the coating material nozzle 24. However, the embodiment allows for elimination of the pin electrode 31. In such a case, formation of the ionized area forward of the air cap 40 is slightly weakened in comparison with the case of the above-described embodiment. However, the coating material discharged from the coating material delivery port 30 is electrified with the negative polarity and is atomized. And, since the coating material particles are conveyed to a substance to be coated, by pattern air, with such an embodiment, electrostatic coating may be carried out.

In addition, in this case, at least the tip end portion at the tip end of the coating material nozzle 24 at which the coating material delivery port 30 is formed may be composed of a conductive material such as metal. In such a case, such an effect can be brought about, by which electrification of the coating material particles can be further fostered than in a case where the tip end portion is composed of an insulating material.

In the cases of Embodiments 1, 2 and 4, although the pin electrode 31 is grounded via a coating material having electric conductivity, the pin electrode 31 may be grounded with a wiring cable. Thereby, the grounding is made secure, and safety can be increased. Furthermore, electrostatic coating of a solvent-based coating material whose electric resistance is high can be carried out.

INDUSTRIAL APPLICABILITY

As described above, a spray gun for electrostatic coating according to the invention is preferred as a spray gun for carrying out electrostatic coating using an aqueous coating material and a metallic coating material whose electric resistance is low.

What is claimed is:

1. An electrostatic coating spray gun for electrifying a coating material atomized by compressed air using high voltage and coating the same onto a substance to be coated, the spray gun comprising:

a barrel constituting a main body of the spray gun;

an air cap mounted on a front of the barrel;

a coating material delivery port which is defined in a central part of the air cap and is open outwardly;

a centralized electrode protruding forward through the coating material delivery port;

a first pair of projections provided at respective upper and lower positions of said air cap and formed at respective radial opposing positions of the air cap while sandwiching the centralized electrode therebetween, and said projections protruding farther forward than the coating material delivery port;

a second pair of projections provided at respective left and right positions in a diametrical direction of the air cap with the centralized electrode placed therebetween, said second pair projecting forward from the coating material delivery port, wherein each of said projections has a pattern air port hole so that compressed air is spouted inwardly forward with respect to the projections; and a first pair of insulatively shielded electrodes accommodated in interiors of the respective first pair of projections and having respective surfaces covered with an electrically insulating material;

a second pair of insulatively shielded electrodes having respective surfaces covered with an electrically insulating material, said second pair being accommodated, respectively, in said second pair of projections, wherein the centralized electrode is grounded and a high DC voltage is applied between the centralized electrode and the insulatively shielded electrodes so that air near a distal end of the centralized electrode is ionized and so that electrons are emitted from the centralized electrode;

the insulatively shielded electrodes protrude forward;

the insulatively shielded electrodes have distal ends covered by the projections located in front of the insulatively shielded electrodes, respectively; and the projections include portions other than the pattern air port holes, which portions, respectively, cover portions other than portions of the insulatively shielded electrodes opposed to the pattern air port holes.

2. The electrostatic coating spray gun according to claim 1, wherein the barrel has an outer periphery and the air cap includes an outer cylinder, the spray gun further comprising a retaining nut threadingly engaged with the outer periphery of the barrel, the retaining nut having a shaping air spout port which is located near the tip end of the barrel so that compressed air is spouted forward along an outer surface of the outer cylinder of the air cap from the shaping air spout port.

3. The electrostatic coating spray gun according to claim 1, wherein said projections are multi-walled bodies each having an elongated cavity which receives a respective one of said shielded electrodes.

4. The electrostatic coating spray gun according to claim 1, wherein said pattern air port holes in said projections spout air diagonally radially inward forward.

5. The electrostatic coating spray gun according to claim 1, wherein each of said projections has a multi-sided wall extending around a respective side surface of said shielded electrodes and a cap end wall extending over a respective free end of said shielded electrodes, and wherein said multi-sided wall of said projections include said port holes through which the compressed air is spouted.

6. The electrostatic coating spray gun according to claim 1, wherein said centralized electrode is a pin electrode.

7. The electrostatic coating spray gun according to claim 1, wherein the centralized electrode is grounded by a wiring cable.

* * * * *